US007824206B1

(12) United States Patent
Wilson et al.

(10) Patent No.: US 7,824,206 B1
(45) Date of Patent: Nov. 2, 2010

(54) DIGITAL MULTIMEDIA CONNECTORS THAT SECURE TO CORRESPONDING DIGITAL MULTIMEDIA RECEPTACLES

(75) Inventors: Brian Wilson, Liberty, MO (US); Arvind Ramdas Mallya, Walnut Creek, CA (US); William E. Rollins, Fremont, CA (US)

(73) Assignee: AT&T Intellectual Property I, L.P., Reno, NV (US)

( * ) Notice: Subject to any disclaimer, the term of this patent is extended or adjusted under 35 U.S.C. 154(b) by 0 days.

(21) Appl. No.: 12/622,690

(22) Filed: Nov. 20, 2009

(51) Int. Cl.
*H01R 13/627* (2006.01)

(52) U.S. Cl. ..... 439/350; 439/352

(58) Field of Classification Search ..... 439/350, 439/352, 638
See application file for complete search history.

(56) References Cited

U.S. PATENT DOCUMENTS 5,011,424 A * 4/1991 Simmons ..... 439/352
5,154,629 A * 10/1992 Carver et al. ..... 439/352
5,197,900 A * 3/1993 Ellis et al. ..... 439/352
5,445,534 A * 8/1995 Ishizuka et al. ..... 439/352
5,702,266 A * 12/1997 Jones ..... 439/357
6,361,363 B1 * 3/2002 Hwang ..... 439/555
6,461,185 B2 * 10/2002 James ..... 439/352
7,175,465 B1 * 2/2007 Tsai ..... 439/352
7,214,087 B2 5/2007 Kuo
7,318,740 B1 * 1/2008 Henry et al. ..... 439/352
7,455,545 B2 * 11/2008 Chawgo et al. ..... 439/353
2005/0221656 A1 * 10/2005 Haga et al. ..... 439/352
2006/0019543 A1 * 1/2006 Charna ..... 439/638
2006/0141843 A1 6/2006 Huang et al.
2008/0248671 A1 10/2008 Chawgo et al.

* cited by examiner

*Primary Examiner*—Tho D Ta
(74) *Attorney, Agent, or Firm*—Toler Law Group

(57) ABSTRACT

A system includes a digital multimedia connector of a digital multimedia cable. The digital multimedia connector includes a first housing enclosing a first plurality of electrical contacts, a retainer adjacent and external to the first housing, and a release. The system includes a digital multimedia receptacle. The digital multimedia receptacle includes a second housing to receive the first housing of the digital multimedia connector, a second plurality of electrical contacts to couple to the first plurality of electrical contacts, and a support to receive at least a portion of the retainer. The digital multimedia cable is inhibited from separating from the digital multimedia receptacle and an electrical connection between the first plurality of electrical contacts and the second plurality of electrical contacts is maintained when the retainer of the digital multimedia connector is received by the support of the digital multimedia receptacle.

15 Claims, 3 Drawing Sheets

DIGITAL MULTIMEDIA CONNECTORS THAT SECURE TO CORRESPONDING DIGITAL MULTIMEDIA RECEPTACLES

FIELD OF THE DISCLOSURE

The present disclosure is generally related to digital multimedia cables that secure to corresponding digital multimedia receptacles mounted in an electronic device.

BACKGROUND

A digital multimedia cable, such as a high definition multimedia interface (HDMI) cable (HDMI and the HDMI logo are trademarks or registered trademarks of HDMI Licensing, LLC), may be used to connect two electronic devices together to allow for the transfer of video content, audio content, and other information between the electronic devices. A digital multimedia connector at an end of the digital multimedia cable may include a grip and an insertable connector. The insertable connector may be positioned in a complementary digital multimedia receptacle to establish an electrical connection. The insertable connector may tightly fit in the digital multimedia receptacle to inhibit undesired removal of the connector from the digital multimedia receptacle. In addition, the insertable connector, or the digital multimedia receptacle, may include one or more spring tabs that extend into recesses in the digital multimedia receptacle, or the connector, to form an interference fit to provide additional retention of the insertable connector in the digital multimedia receptacle. For some uses of digital multimedia cables, the weight of a wiring cord of the digital multimedia cable or external forces applied to the wiring cord, may apply force to the digital multimedia connector that acts to remove the insertable connector from the digital multimedia receptacle. The force applied to the digital multimedia connector may degrade or break the electrical connection established by the digital multimedia connector. When the digital multimedia cable is a conduit that passes media content from a media content provider to a customer device, a degraded electrical connection or a break in the electrical connection may result in a service call where a technician travels to a customer residence and reestablishes a good electrical connection between the digital multimedia cable and customer premises equipment (e.g., a set-top box device). The need for such service calls may result in customer dissatisfaction, and adds expense for a service provider.

Figure 1:
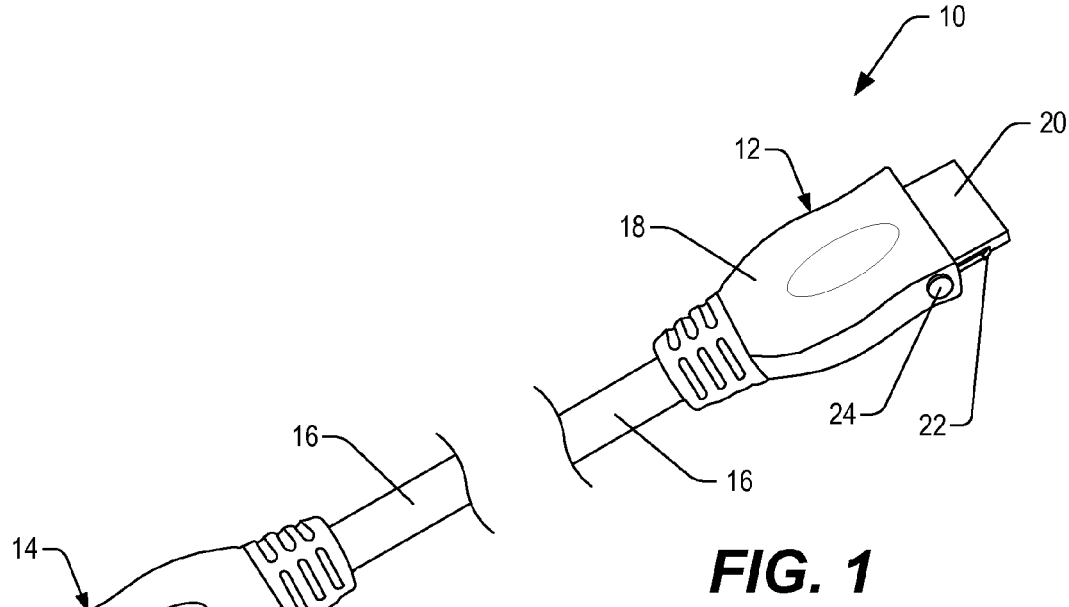
FIG. 1 is a perspective representation of a first embodiment of a digital multimedia cable.

Specific embodiments are shown by way of example in the drawings and will be described herein in detail. The drawings may not be to scale.

DETAILED DESCRIPTION

In a particular embodiment, a digital multimedia cable includes a digital multimedia connector at a first end of the digital multimedia cable. The digital multimedia connector includes a grip and an insertable connector. The insertable connector includes a housing enclosing a plurality of electrical contacts. The digital multimedia connector includes a first retainer on a first side of the housing. The first retainer is configured to enter a corresponding recess of a digital multimedia receptacle to secure the digital multimedia connector to the digital multimedia receptacle. The digital multimedia receptacle is mounted in an electronic device and configured to receive the insertable connector. The digital multimedia connector includes a second retainer on a second side of the housing. The second side is opposite the first side. The second retainer is configured to enter a corresponding second recess of the digital multimedia receptacle to secure the digital multimedia connector to the digital multimedia receptacle, the digital multimedia receptacle. The digital multimedia cable includes a first release in the grip for the first retainer and a second release in the grip for the second retainer. The first release is configured to facilitate removal of the insertable connector from the digital multimedia receptacle by reducing a bias force applied to the first retainer to move the first retainer into the first recess when the first release is activated. The second release is configured to facilitate removal of the insertable connector from the digital multimedia receptacle by reducing a bias force applied to the second retainer to move the second retainer into the second recess when the second release is activated. Electrical contacts of the digital multimedia connector are in contact with electrical contacts of the digital multimedia receptacle when at least a portion of the first retainer is positioned in the corresponding first recess and at least a portion of the second retainer is positioned in the corresponding second recess.

In a particular embodiment, a system includes a digital multimedia connector of a digital multimedia cable. The digital multimedia connector includes a first housing enclosing a first plurality of electrical contacts, a retainer adjacent and external to the first housing, and a release. The system includes a digital multimedia receptacle. The digital multimedia receptacle includes a second housing to receive the first housing of the digital multimedia connector, a second plurality of electrical contacts to couple to the first plurality of electrical contacts, and a support to receive at least a portion of the retainer. The digital multimedia cable is inhibited from separating from the digital multimedia receptacle and an electrical connection between the first plurality of electrical contacts and the second plurality of electrical contacts is maintained when the retainer of the digital multimedia connector is received by the support of the digital multimedia receptacle.

In a particular embodiment, a set-top box device includes a body and a cover that at least partially encloses electronic components. The set-top box device includes a digital multimedia receptacle coupled to the body. The digital multimedia receptacle includes a receptacle housing. The set-top box device includes an opening in the cover adjacent to the digital multimedia receptacle. The opening is sized and shaped to allow insertion of one or more retainers of a digital multimedia connector into the opening. The one or more retainers are positioned adjacent and external to an insertable connector of the digital multimedia connector that fits inside of the receptacle housing. The set-top box device also includes a support to engage at least one of the one or more retainers to inhibit removal of the digital multimedia connector from the digital multimedia receptacle.

FIG. 1 depicts a perspective representation of a first embodiment of a digital multimedia cable 10. The digital multimedia cable 10 may include a first digital multimedia connector 12, a second digital multimedia connector 14, and a wiring cord 16 connecting the first digital multimedia connector 12 to the second digital multimedia connector 14. The digital multimedia connectors 12, 14 may each include a grip 18 and an insertable connector 20. The grip 18 may facilitate placement of the insertable connector 20 in a digital multimedia receptacle of an electronic device. The insertable connector 20 may be sized and shaped to provide a tight fit in the digital multimedia receptacle of the electronic device.

The first digital multimedia connector 12 may include a retainer 22 and a release 24. The first digital multimedia connector 12 may include retainers 22 and releases 24 on each side of the first digital multimedia connector 12. The retainers 22 may be external to the insertable connector 20 with no portion of the retainers 22 passing through the insertable connector 20. The retainer 22 and the release 24 are shown in FIG. 1 positioned on a narrow side of the grip 18.

The retainer 22 may engage a portion of the digital multimedia receptacle or a portion of the electronic device to inhibit removal of the digital multimedia cable 10 from the digital multimedia receptacle when the insertable connector 20 is positioned in the digital multimedia receptacle. The release 24 may reduce a bias force applied to the retainer 22 that serves to secure the digital multimedia connector 12 to the digital multimedia receptacle. Reducing the bias force facilitates separation of the digital multimedia connector 12 from the digital multimedia receptacle. In the embodiment depicted in FIG. 1, the release 24 is a button on a side of the grip 18 of the digital multimedia connector 12. In an embodiment, the digital multimedia connector includes releases 24 on each side of the digital multimedia connector 12. The releases 24 may be spring loaded buttons on opposite sides of the grip 18. The releases 24 allow release of the digital multimedia connector 12 from the digital multimedia receptacle when a user grasps the grip 18 and moves the spring loaded buttons towards each other.

In a particular embodiment, the retainers 22 may be adjacent and external to the insertable connector 20. The retainers 22 may be positioned adjacent to side surfaces of the insertable connector 20. The engaging surfaces of the retainers 22 may engage surfaces defined by recesses or openings in the portion of the digital multimedia receptacle that the insertable connector 20 is placed in. The release 24 may be a slide or a cam that moves the retainers 22 away from the insertable connector 20 to allow the digital multimedia connector 12 to be separated from the electronic device. Other release systems that facilitate release of the digital multimedia cable 10 from the digital multimedia receptacle may also be implemented.

In the embodiment depicted in FIG. 1, the second digital multimedia connector 14 is a standard digital multimedia connector that does not include a retainer and a release. In other embodiments, both of the digital multimedia connectors 12 and 14 of the digital multimedia cable 10 may include retainers 22 and releases 24.

The digital multimedia connector 12 may be inserted into the digital multimedia receptacle by a user. The user may grasp the grip 18 of the digital multimedia connector 12 and press the releases 24. The user may guide the insertable connector 12 into the digital multimedia receptacle. When the digital multimedia connector 12 is positioned in the digital multimedia receptacle, the user may stop pressing the releases 24. After the user has stopped pressing the releases 24, the user may test that the retainers 22 secure the digital multimedia connector 12 to the digital multimedia receptacle by applying a removal force to the grip 18. The user may reinsert the digital multimedia connector 12 into the digital multimedia receptacle when the digital multimedia connector 12 begins to separate from the digital multimedia receptacle due to the applied removal force. The user may release the grip 18 when the applied removal force does not result in the digital multimedia connector 12 separating from the digital multimedia receptacle. When a user desires to disconnect the connector 12 from the receptacle, the digital multimedia connector 12 may be removed from the digital multimedia receptacle by grasping the grip 18, pressing the releases 24, and applying a removal force to separate the digital multimedia connector 12 from the digital multimedia receptacle. Thus, the digital multimedia connector 12 may be selectively secured to the receptacle or released from the receptacle.

Figure 2:
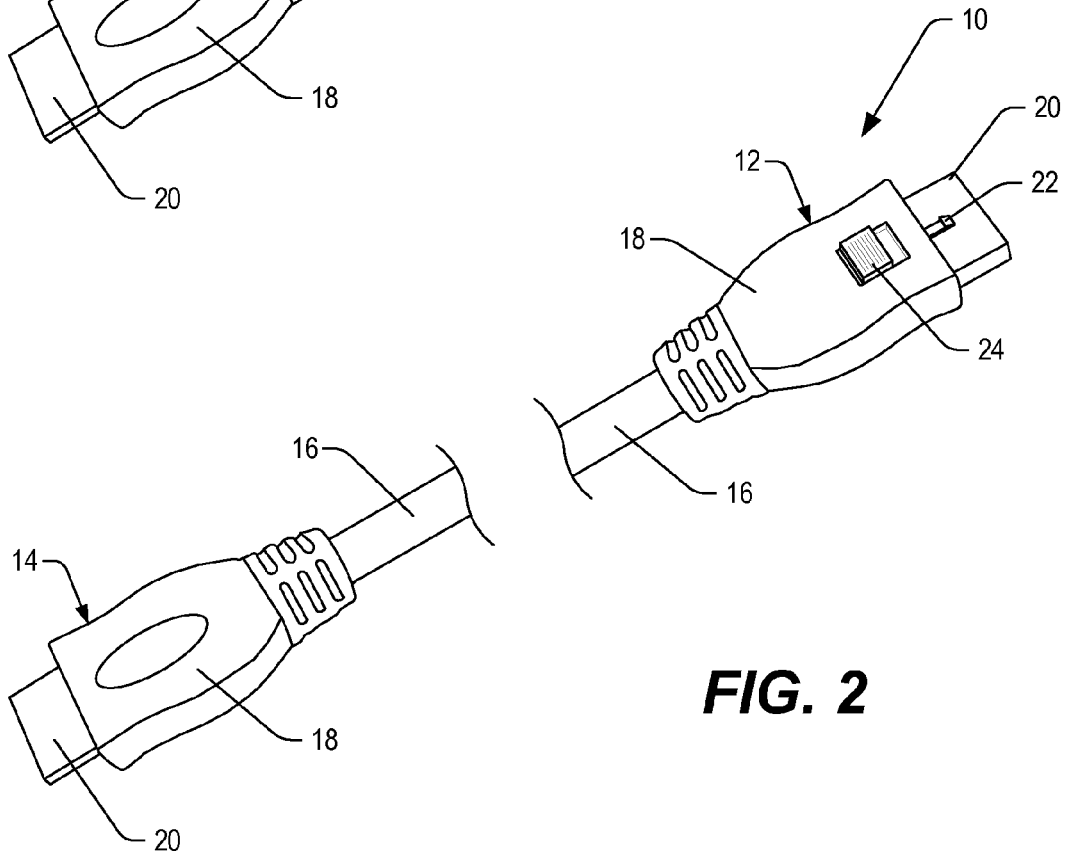
FIG. 2 is a perspective representation of a second embodiment of a digital multimedia cable.

FIG. 2 depicts a perspective representation of a second embodiment of the digital multimedia cable 10. The digital multimedia cable 10 may include a first digital multimedia connector 12, a second digital multimedia connector 14, and a wiring cord 16 connecting the first digital multimedia connector 12 to the second digital multimedia connector 14. The digital multimedia connectors 12, 14 may each include a grip 18 and an insertable connector 20. The grip 18 may facilitate placement of the insertable connector 20 in a digital multimedia receptacle of an electronic device. The insertable connector 20 may be sized and shaped to provide a tight fit in the digital multimedia receptacle of the electronic device.

The first digital multimedia connector 12 may include a retainer 22 and a release 24. The retainer 22 is shown adjacent to a top surface of the insertable connector 20. The release 24 is shown in a top surface of the grip 18. A second retainer 22 may be located adjacent to a bottom surface of the insertable connector 20. A second release 24 may be located in a bottom surface of the grip 18. The retainers 22 may be external to the insertable connector 20 with no portion of the retainers 22 passing through the insertable connector 20.

The release 24 may be a slide. Moving the release 24 may extend or retract a sleeve or cam. The sleeve or cam may apply a bias force to the retainers 22. The grip 18 may include indicia. The indicia may indicate whether the first digital multimedia connector 12 is in a locked or unlocked position. When the first digital multimedia connector 12 is in a locked position (as depicted in FIG. 2), the sleeve or cam is withdrawn to allow the retainer 22 to engage a support when the first digital multimedia connector 12 is inserted in the digital multimedia receptacle. When the retainer 22 engages the support, removal of the digital multimedia connector 12 from the digital multimedia receptacle is inhibited. A user who desires to remove the digital multimedia connector 12 from the digital multimedia receptacle may slide the release 24 to extend the sleeve or cam and press the retainers 22 against the insertable connector 20 so that interference or a bias force provided by the retainers to secure the digital multimedia connector to the digital multimedia receptacle is removed. The user may grasp the grip 18 and apply a force to remove the digital multimedia connector 12 from the digital multimedia receptacle.

Figure 3:
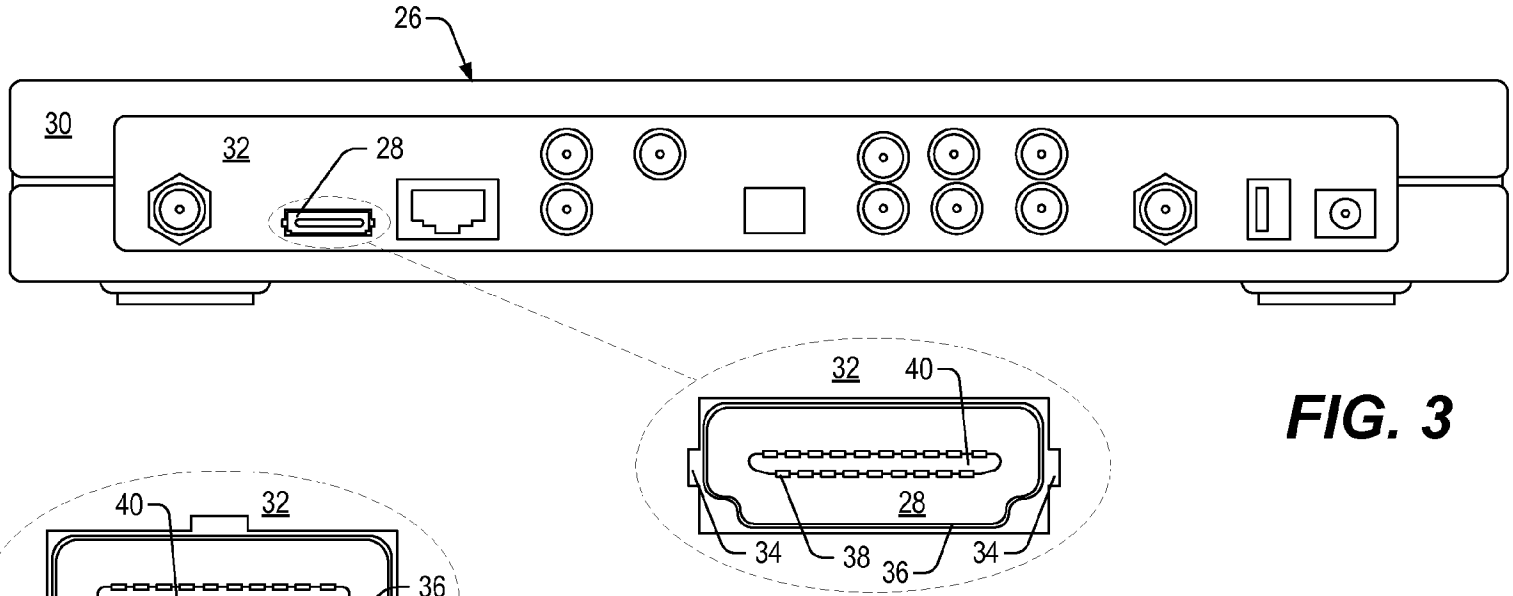
FIG. 3 is a first embodiment of a rear view of an electronic device with a digital multimedia receptacle, with an enlarged representation of the digital multimedia receptacle.

FIG. 3 depicts a first embodiment of a rear view of an electronic device 26 that includes one or more digital multimedia receptacles 28 that are able to receive a standard digital multimedia connector (e.g., the second digital multimedia connector 14 depicted in FIG. 1 and FIG. 2) or a digital multimedia connector with retainers adjacent to a narrow side of the insertable connector (e.g., the first digital multimedia connector 12 depicted in FIG. 1). The electronic device 26 may be a set-top box device. The electronic device 26 may include a body 30 and a cover 32. The body 30 may include one or more supports for printed circuit boards, electrical components, and non-electrical components of the electronic device 26. Ports for selected electrical components of the electronic device 26 may be accessed from a rear surface of the electronic device 26. Cables or other types of connectors may be coupled to the ports.

The ports may include or may be connected to the one or more digital multimedia receptacles 28. The one or more digital multimedia receptacles 28 may be coupled to the body 30 by screws, snap connects, soldering, adhesive, other connectors, or combinations thereof. The cover 32 may be positioned adjacent to the ports. The cover 32 may inhibit material from entering into the electronic device 26 adjacent to the ports. The cover 32 may include an opening having a width that is greater than a height for each digital multimedia receptacle 28. The cover 32 may include one or more passages 34 in sides of the opening corresponding to the height of the opening. The passages 34 may accommodate retainers of a digital multimedia connector (e.g., the digital multimedia connector 12 of FIG. 1) to be coupled to the digital multimedia receptacle 28.

As shown in the enlarged portion of FIG. 3, the digital multimedia receptacle 28 may include a housing 36. A plurality of electrical contacts 38 may be positioned on a mount 40 in the housing 36.

Figure 4:
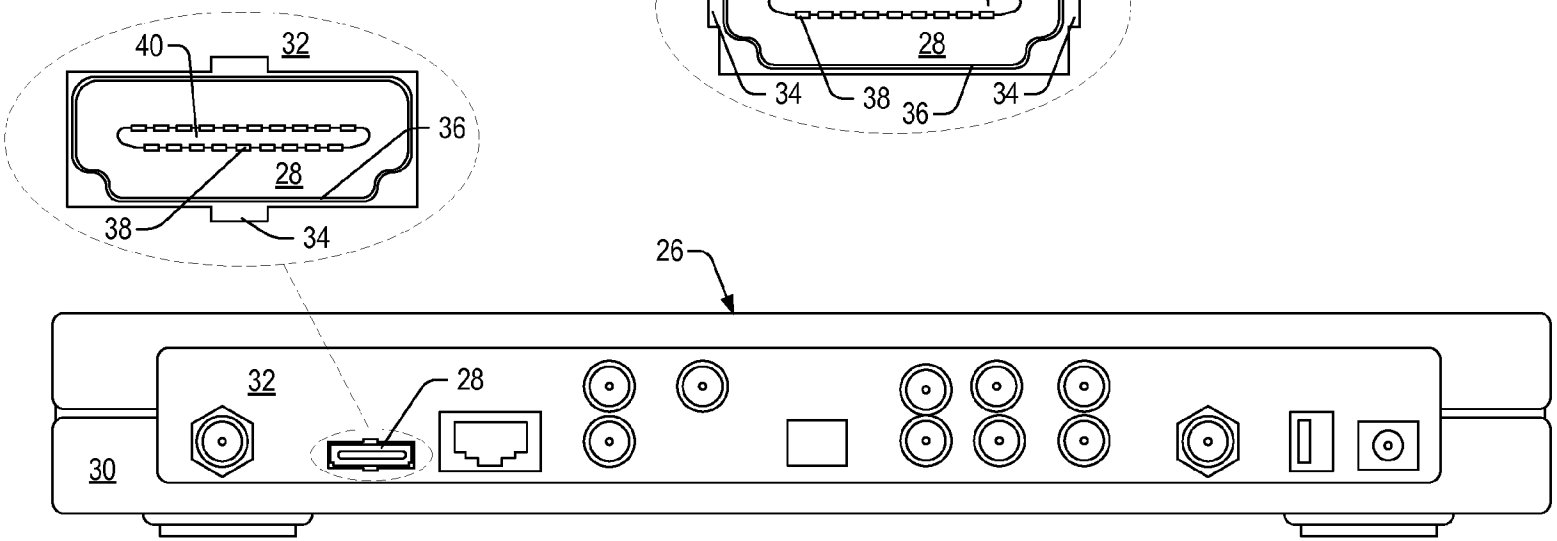
FIG. 4 is a second embodiment of a rear view of an electronic device with a digital multimedia receptacle, with an enlarged representation of the digital multimedia receptacle.

FIG. 4 depicts a second embodiment of a rear view of an electronic device 26 with one or more digital multimedia receptacles 28 that are able to receive a standard digital multimedia connector (e.g., the second digital multimedia connector 14 depicted in FIG. 1 and FIG. 2) or a digital multimedia connector with retainers adjacent to a wide side of an insertable connector of the digital multimedia connector (e.g., the first digital multimedia connector 12 depicted in FIG. 2). The cover 32 may include an opening having a width that is greater than a height for each digital multimedia receptacle 28. The cover 32 of the electronic device 26 may include one or more passages 34 in sides of the opening corresponding to the width of the opening. The passages 34 may accommodate retainers of a digital multimedia connector to be coupled to the digital multimedia receptacle 28.

As shown in the enlarged portion of FIG. 4, the digital multimedia receptacle 28 may include a housing 36. A plurality of electrical contacts 38 may be positioned on a mount 40 in the housing 36.

Figure 5:
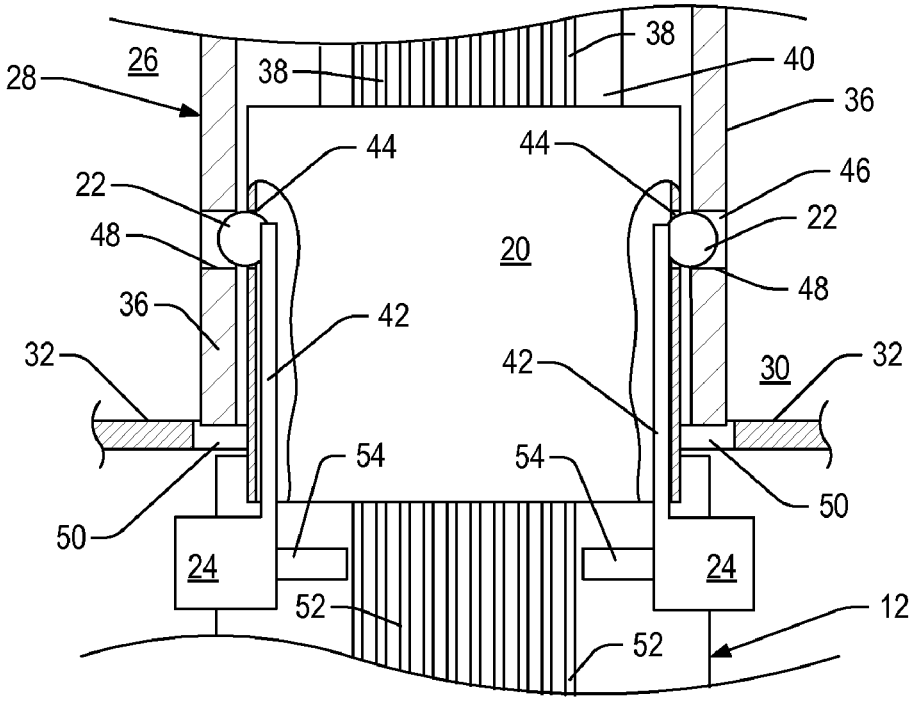
FIG. 5 is a first embodiment of a schematic representation of a portion of a digital multimedia connector coupled to a portion of a digital multimedia receptacle.

FIG. 5 depicts a first embodiment of a schematic representation of a portion of a digital multimedia connector 12 coupled to a portion of a digital multimedia receptacle 28. The digital multimedia receptacle 28 may be secured to the body 30 of the electronic device 26. Sections of insertable connector 20 of the digital multimedia connector 12 are represented in cut-out and cross section to show the position of retainer arms 42 coupled to the retainers 22 in the insertable connector 20. Portions of the retainers 22 may pass through openings 44 in the insertable connector 20.

Portions of the digital multimedia receptacle 28 are represented in cross section in FIG. 5 to show openings 46 in a housing 36 of the digital multimedia receptacle 28. In some embodiments, the openings 46 may be recesses in the digital multimedia receptacle 28 that do not extend completely through the digital multimedia receptacle 28.

A portion of the cover 32 of the electronic device 26 is shown in cross section to show an opening 50 in the cover 32 in which the digital multimedia receptacle 28 is positioned. When a user inserts the insertable connector 20 into the digital multimedia receptacle 28, the user inserts the insertable connector 20 through the opening 50 and into the housing 36 of the digital multimedia receptacle 28. The retainers 22 of the digital multimedia connector 12 may be in the insertable connector 20. Positioning the retainers 22 in the insertable connector 20 may allow the opening 50 in the cover 32 to conform to the shape of the digital multimedia receptacle 28 without the need to accommodate external retainers (e.g., the retainer 22 depicted in FIG. 1 and the retainer 22 depicted in FIG. 2).

Electrical contacts 52 of the digital multimedia connector 12 may pass into the insertable connector 20. When the insertable connector 20 is positioned in the housing 36 of the digital multimedia receptacle 28, the electrical contacts 52 may touch or make contract with corresponding electrical contacts 38 of the digital multimedia receptacle 28 to electrically couple the digital multimedia connector 12 to the digital multimedia receptacle 28. The electrical contacts 38 may be mounted on a mount 40 that extends into the housing 36. The housing 36, the electrical contacts 38, and the mount 40 are also shown in FIG. 3.

The retainers 22 of the digital multimedia connector 12 may be coupled to the retainer arms 42, which are coupled to the releases 24. The releases 24 may be in contact with one or more bias members 54. The bias members 54 may be elastomers, coil springs, or other mechanisms that apply outward directed forces to the releases 24. The forces applied by the bias members 54 to the releases 24 may act through the retainer arms 42 to move the retainers 22 through the openings 44 in the insertable connector 20. When inserting the digital multimedia connector 12 into the digital multimedia receptacle 28, the user may press the releases 24 inwards to allow the retainers 22 to pass into the housing 36 of the digital multimedia receptacle 28. Once the retainers 22 are in the housing 36 of the digital multimedia receptacle 28, the user may stop pressing the releases 24. The user may insert the insertable connector 20 into the housing 36 until openings 44 in the insertable connector 20 align with the openings 46 in the housing 36. When the openings 44 are aligned with the openings 46, the forces applied by the bias members 54 to the retainers 22 position portions of the retainers 22 in the openings 46 in the housing 36. The portions of the retainers 22 positioned in the openings 46 are sufficient to form an interference fit between the portions of the retainers 22 and surfaces 48 of the housing 36 defined by the openings 46. The interference fit inhibits unintentional removal of the digital multimedia connector 12 from the digital multimedia receptacle 28. When the retainers 22 are positioned in the openings 46 in the digital multimedia receptacle 28, a force applied to the digital multimedia connector 12 to remove the digital multimedia connector 12 from the digital multimedia receptacle 28 may be resisted by the interaction of the retainers 22 with the surfaces 48 of the housing 36 defined by the openings 46. When removal of the digital multimedia connector 12 from the digital multimedia receptacle 28 is desired, the releases 24 may be pressed to withdraw the portions of the retainers 22 from the openings 46 in the digital multimedia receptacle 28 to permit the digital multimedia connector 12 to be withdrawn from the digital multimedia receptacle 28.

Figure 6:
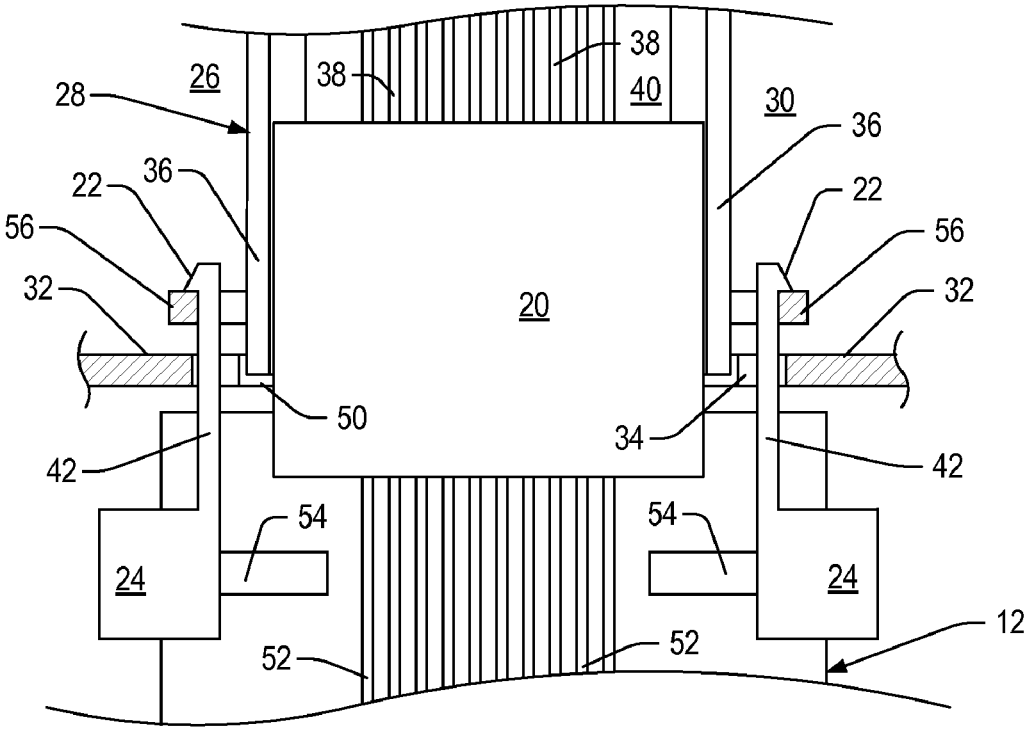
FIG. 6 is a second embodiment of a schematic representation of a portion of a digital multimedia connector coupled to a portion of a digital multimedia receptacle.

FIG. 6 depicts a second embodiment of a schematic representation of a portion of a digital multimedia connector 12 coupled to a portion of a digital multimedia receptacle 28. The digital multimedia receptacle 28 may be secured to the body 30 of the electronic device 26. The digital multimedia connector 12 includes retainers 22 that are adjacent and external to the insertable connector 20.

Electrical contacts 52 of the digital multimedia connector 12 may pass into the insertable connector 20. When the insertable connector 20 is positioned in the housing 36 of the digital multimedia receptacle 28, the electrical contacts 52 may touch or contact corresponding electrical contacts 38 of the digital multimedia receptacle 28 to electrically couple the digital multimedia connector 12 to the digital multimedia receptacle 28. The electrical contacts 38 may be placed on a mount 40 that extends into the housing 36. The housing 36, the electrical contacts 38, and the mount 40 are also shown in FIG. 4.

The retainers 22 of the digital multimedia connector 12 may be coupled to retainer arms 42, which are coupled to the releases 24. The releases 24 may be in contact with one or more bias members 54. The bias members 54 may be elastomers, coil springs, or other mechanisms that apply outward directed forces to the releases 24. The forces applied by the bias members 54 to the releases 24 may act through the retainer arms 42 to move the retainers 22 away from the insertable connector 20. When inserting the digital multimedia connector 12 into the digital multimedia receptacle 28, the user may press the releases 24 inwards to allow the retainers 22 to pass into the openings 34 in the cover 32 of the electronic device 26. The retainers 22 may include slanted surfaces to facilitate insertion of the digital multimedia connector 12 into the digital multimedia receptacle 28. When the digital multimedia connector 12 is fully inserted in the digital multimedia receptacle 28, the retainers 22 may engage supports 56. The supports 56 may be extensions from the digital multimedia receptacle 28 that are offset from the housing 36, may be mounted to the body 30 of the electronic device 26, may be portions of the cover 32, or may be a combination thereof. When the retainers 22 engage the supports 56, removal of the digital multimedia connector 12 from the digital multimedia receptacle 28 may be inhibited or at least resisted unless the releases 24 are pressed to reduce the bias force applied to the retainers 22 by the bias members 54 through the retainer arms 42.

In a particular embodiment, the retainers 22 may engage recesses or openings in the housing 36 so that the support 56 becomes part of the housing 36. The release 24 on a right side of the digital multimedia connector 12 may control the retainer 22 on the left side of the digital multimedia connector 12, and the release 24 on a left side of the digital multimedia connector 12 may control the retainer 22 on the right side of the digital multimedia connector 12. Pressing the releases may move the retainers outwards so that the engaging surfaces of the releases do not interfere with the housing and allow the digital multimedia connector 12 to be removed from the digital multimedia receptacle 28.

Retainers of a digital multimedia connector that secure a digital multimedia connector of a digital multimedia cable to a digital multimedia receptacle may be able to withstand both inadvertent forces applied to the digital multimedia connector and the weight of the digital multimedia cable to inhibit undesired separation of the digital multimedia connector from the digital multimedia receptacle. The use of the digital multimedia cable having at least one digital multimedia connector that secures to the corresponding digital multimedia receptacle may improve electrical performance of electronic devices coupled by the digital multimedia cable and may improve picture quality of video media transferred through the digital multimedia cable due to the improved electrical performance. The use of the digital multimedia cable having at least one digital multimedia connector that secures to a corresponding digital multimedia receptacle may result in fewer subscriber complaints and may obviate the need and expense of service calls to reconnect a poorly connected digital multimedia cable.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments.

The Abstract of the Disclosure is provided with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all such modifications, enhancements, and other embodiments, which fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An apparatus, comprising:

a digital multimedia connector at a first end of a digital multimedia cable, the digital multimedia connector comprising a grip and an insertable connector, wherein the insertable connector includes a housing enclosing a plurality of electrical connection contacts;

a first retainer on a first side of the housing, the first retainer configured to enter a corresponding first recess of a digital multimedia receptacle to secure the digital multimedia connector to the digital multimedia receptacle, the digital multimedia receptacle mounted in an electronic device and configured to receive the insertable connector;

a second retainer on a second side of the housing, the second side opposite the first side, the second retainer configured to enter a corresponding second recess of the digital multimedia receptacle to secure the digital multimedia connector to the digital multimedia receptacle;

a first release in the grip for the first retainer and a second release in the grip for the second retainer, the first release and the second release responsive to at least one bias force;

a first retainer arm coupling the first retainer to the first release; and a second retainer arm coupling the second retainer to the second release, wherein the first release is configured to facilitate removal of the insertable connector from the digital multimedia receptacle by moving the first release in a first direction causing the first retainer arm and the first retainer to move laterally in the first direction and wherein the second release is configured to facilitate removal of the insertable connector from the digital multimedia receptacle by moving the second release in a second direction causing the second retainer arm and the second retainer to move laterally in the second direction;

wherein electrical contacts of the digital multimedia connector are in contact with electrical contacts of the digital multimedia receptacle when at least a portion of the first retainer is positioned in the corresponding first recess and at least a portion of the second retainer is positioned in the corresponding second recess.

2. The apparatus of claim 1, further comprising a second digital multimedia connector at a second end of the digital multimedia cable, wherein the second digital multimedia connector does not include the first retainer and does not include the second retainer.

3. The apparatus of claim 1, wherein the digital multimedia connector is a high definition multimedia interface connector.

4. The apparatus of claim 1, wherein the first release and the second release include a pair of spring loaded buttons in the grip that allow release of the digital multimedia cable from the digital multimedia receptacle when the spring loaded buttons are moved towards each other.

5. The apparatus of claim 1, wherein the electronic device is a set-top box device.

6. The apparatus of claim 1, wherein the first side of the housing is a top surface of the housing and the second side of the housing is a bottom surface of the housing.

7. The apparatus of claim 1, wherein the first side of the housing and the second side of the housing are side surfaces of the housing.

8. The apparatus of claim 1, wherein at the first retainer and the second retainer are external to the housing and do not pass through the housing.

9. The apparatus of claim 1, wherein at least a portion of the first retainer passes through a wall of the housing.

10. The apparatus of claim 1, wherein the first release is on the second side of the housing, and wherein the second release is on the first side of the housing.

11. The apparatus of claim 1, wherein the first retainer and the second retainer each are of a ball shape.

12. A system, comprising:

a digital multimedia connector of a digital multimedia cable, the digital multimedia connector including a first housing enclosing a first plurality of electrical contacts, a first retainer adjacent to a first side of the first housing, a second retainer adjacent to a second side of the first housing, the second side of the housing opposite the first side of the housing, and a release, the release comprising a first button operable to transmit a first force to the first retainer via a first retainer aim and a second button operable to transmit a second force to the second retainer via a second retainer arm; and a digital multimedia receptacle, wherein the digital multimedia receptacle includes a second housing to receive the first housing of the digital multimedia connector, a second plurality of electrical connection contacts to couple to the first plurality of electrical contacts, and a support to receive at least a portion of the retainer;

wherein the digital multimedia cable is inhibited from separating from the digital multimedia receptacle and an electrical connection between the first plurality of electrical contacts and the second plurality of electrical contacts is maintained when the retainer of the digital multimedia connector is received by the support of the digital multimedia receptacle, wherein the digital multimedia cable is configured to be separated from the digital multimedia receptacle by pushing the first button in a first direction causing the first retainer arm and the first retainer to move laterally in the first direction and by pushing the second button in a second direction causing the second retainer arm and the second retainer to move laterally in the second direction, wherein the second direction is opposite the first direction.

13. The system of claim 12, wherein activation of the release reduces a bias force applied to the retainer to enable removal of the first housing from the second housing.

14. The system of claim 12, wherein the support of the digital multimedia receptacle is within the second housing.

15. The system of claim 12, wherein the support of the digital multimedia receptacle is offset from the second housing.

* * * * *